US006682049B2

(12) United States Patent
Thompson

(10) Patent No.: US 6,682,049 B2
(45) Date of Patent: Jan. 27, 2004

(54) CONCRETE EXTRACTION SYSTEM

(75) Inventor: Jeffrey L. Thompson, Snellville, GA (US)

(73) Assignee: Harbor Design Systems, Inc., Snellville, GA (US)

( * ) Notice: Subject to any disclaimer, the term of this patent is extended or adjusted under 35 U.S.C. 154(b) by 27 days.

(21) Appl. No.: 10/099,845

(22) Filed: Mar. 13, 2002

(65) Prior Publication Data

US 2003/0172511 A1 Sep. 18, 2003

(51) Int. Cl.[7] ..... B66F 11/00

(52) U.S. Cl. ..... 254/8 R; 254/131

(58) Field of Search ..... 254/8 B, 131, 254/120, 121, 123, 131.5; 269/21; 294/64.1, 64.2, 64 B, 65; 414/627, 737, 744 A, 744 B, 752; 271/103, 106

(56) References Cited

U.S. PATENT DOCUMENTS 3,061,351 A 10/1962 Johnson
3,584,836 A * 6/1971 Brubaker, Sr. ..... 254/124
3,728,891 A 4/1973 Hall, Jr.
4,091,945 A 5/1978 Patterson
4,166,648 A 9/1979 Creskoff
4,365,925 A * 12/1982 Girtz ..... 414/684.3
4,662,607 A 5/1987 Mochizuki et al.
4,707,012 A * 11/1987 Takagi ..... 294/64.1
4,787,812 A 11/1988 Gopfert
5,033,730 A * 7/1991 Davies et al. ..... 271/106
5,382,131 A 1/1995 Werthmann
5,752,729 A 5/1998 Crozier et al.
6,039,371 A 3/2000 Smith
6,095,581 A 8/2000 Brewer

* cited by examiner

*Primary Examiner*—Robert C. Watson
(74) *Attorney, Agent, or Firm*—Hinkle & O'Bradovich, LLC

(57) ABSTRACT

Systems and Methods for extracting concrete blocks or other materials cut from a surface is disclosed. An extraction apparatus typically includes a leveraging device connected to a vacuum cup and vacuum pump. The vacuum cup is placed on the material to be removed. A vacuum is pulled on the vacuum cup. The leveraging device is maneuvered to lift the material. The vacuum can be removed when the material is moved to the desired location.

9 Claims, 4 Drawing Sheets

CONCRETE EXTRACTION SYSTEM

BACKGROUND OF THE INVENTION

I. Field of the Invention

The present invention relates generally to the field of concrete, and more particularly to a system and method for extracting concrete.

II. Description of the Related Art.

Often times concrete surfaces, such as floors, need to be cut and a portion removed. For example, a concrete floor may be cut in order to lay pipes or conduit during remodeling for many other purposes. Typically, a concrete cutting machine cut is used to cut trenches in the concrete in order to place the desired objects within the trench. Typically, lines are cut around large blocks of concrete. Once the concrete has been cut, it is necessary to remove the large blocks. Consequently, the cut concrete is difficult to remove because it is difficult to pick up the concrete without either breaking it up or lifting the resulting pieces in some manner.

SUMMARY OF THE INVENTION

In accordance with the present invention and the contemplated problems which have and continue to exist in this field, in one aspect, the invention features an extraction apparatus, including an elongated frame having a first end and a second end, a handling bar connected to the first end of the frame, a vacuum cup frame connected to the second end of the frame, a vacuum cup connected to the vacuum cup frame, a wheel pivot bar connected to the frame between the first and second ends and wheels connected to the wheel pivot bar.

In an implementation, the distance between the wheel pivot bar and the second end is less than the distance between wheel pivot bar and the first end.

In another implementation, the wheels are adapted to be a fulcrum.

In another implementation, the apparatus further includes a vacuum pump connected to the frame and a hose connected between the vacuum pump and the vacuum cup.

In another implementation, the frame includes a first upper bar connected to a second upper bar at an angle, the first upper bar being connected to the handling bar, a first lower bar connected to the first upper bar at an angle, and connected to a second lower bar, the second lower bar being connected to the second upper bar at an angle and a support frame connected to the wheel pivot bar and to the intersection of the first upper bar and second upper bar.

In another implementation, the vacuum cup frame includes a first bar, a second bar connected to and substantially perpendicular to the first bar and a series of cylindrical tubes connected to and substantially perpendicular to the second bar.

In still another implementation, the vacuum cup frame further includes inclined bars connected to the first bar and the second bar.

In still another implementation, the vacuum cup includes a series of cylindrical tubes that interleave and align with the cylindrical tubes on the vacuum cup frame.

In another aspect, the invention features an extraction apparatus, including a bar having a first end and a second end, a handling bar connected substantially perpendicular to the bar at the first end, a bracket connected to the second end of the bar and a vacuum cup connected to the bracket.

In an implementation, the apparatus includes a bar connected to the bracket and to a cylindrical tube on the vacuum cup.

In another implementation, the apparatus includes a vacuum pump and a hose connected to the vacuum pump and to the vacuum cup.

In another aspect, the invention features an extraction method, including cutting a piece of material from a surface for removal, providing a extraction apparatus including a vacuum cup and a vacuum pump coupled to the vacuum cup, placing the vacuum cup over the piece of material to be removed, pulling a vacuum in the vacuum cup with the vacuum pump, lifting the material from the surface, placing the material in a desired location and removing the vacuum from the vacuum cup.

In another aspect, the invention features a concrete extraction kit, including a vacuum pump, a vacuum cup and a hose adapted to be connected to the vacuum cup and the vacuum pump, wherein the vacuum cup and the vacuum pump are adapted to connect to a leveraging device.

In one implementation, the leveraging device is an elongated frame having a first end and a second end, having a handling bar on the first end and a vacuum cup frame on the second end, the vacuum cup being adapted to affix to the vacuum cup frame, and wherein the vacuum pump is adapted to connect to the frame.

In another implementation, the frame further includes wheels connected to the frame by a wheel pivot bar, the wheel pivot bar adapted to act as a fulcrum.

In another implementation, the leveraging device is a bar having a first end and a second end, wherein a handling bar is connected substantially perpendicular to the bar at the first end, and a bracket is connected to the second end of the bar, the bracket being adapted to connect to the vacuum cup.

In another aspect, the invention features a concrete extraction apparatus, including at least one vacuum cup, means for lifting and lowering the vacuum cup and means for pulling a vacuum inside the vacuum cup.

One advantage of the invention is that it provides a simplified apparatus and method for removing and moving blocks of material in remodeling and construction.

Another advantage is an operator of the invention exerts less force than by conventional methods.

Another advantage is that the removed material can be preserved.

Another advantage is that less rubble is formed when removing block materials.

Other objects, advantages and capabilities of the invention will become apparent from the following description taken in conjunction with the accompanying drawings showing the preferred embodiment of the invention.

DETAILED DESCRIPTION OF THE INVENTION

Figures 1, 2:
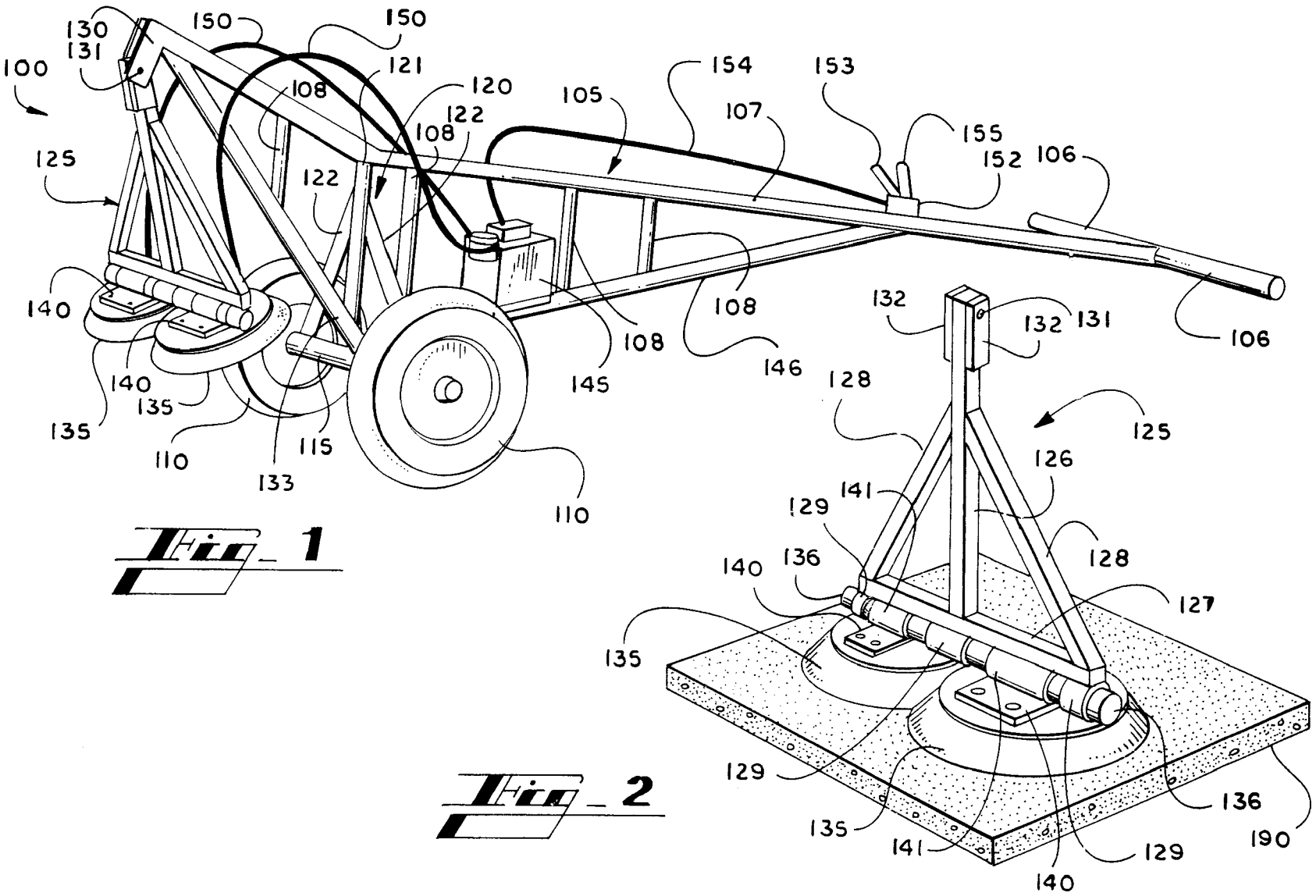
FIG. 1 illustrates a view of an embodiment of a concrete extraction apparatus.
FIG. 2 illustrates an embodiment of a vacuum cup frame and a block of material.

Referring to the drawings wherein like reference numerals designate corresponding parts throughout the several figures, reference is made first to FIG. 1 that illustrates a view of an embodiment of a concrete extraction apparatus 100. The apparatus 100 includes a frame 105 having a handling bar 106. The frame 105 includes a first upper bar 107 and a first lower bar 146, a second upper bar 130 and a second lower bar 133. Several cross bars 108 are connected between the first upper and lower bars 107, 146 and between the second upper and lower bars 130, 133. Wheels 110 are connected to the frame 105 substantially perpendicular to a wheel pivot bar 115. The wheel pivot bar 115 is connected to the frame 105. A support frame 120 is connected to the frame 105 and the wheel pivot bar 115. The frame 120 includes a center bar 121 and two inclined bars 122. The center bar is connected to the wheel pivot bar at its lower end and to the intersection of the bars 107, 130. The inclined bars 122 are connected to the center bar 121 and to the wheel pivot bar 115. A vacuum cup frame 125 is connected to an upper bar 130 of the frame 105 at a pivot point 131. The bar 130 is shown as an L-shape. In another embodiment, the upper bar 130 can be straight with the pivot point 131 on the end. It is understood that different orientations of the bars of the frame 105 is possible without departing from the spirit of the invention.

Two vacuum cups 135 are connected to the vacuum cup frame 125 by attachment plates 140. The vacuum cups 135 typically include a flexible and resilient material such as a durable rubber. The vacuum cup frame 125 and the attachment of the vacuum cups 135 are described further below with respect to FIG. 2.

The apparatus 100 further includes a vacuum pump 145 connected to the frame 105. The vacuum pump is illustrates as attached to a lower bar 146 of the frame 105. The vacuum pump can typically be connected at any desired location on the apparatus 100. Hoses 150 are connected to both the vacuum cups 135 and to the vacuum pump 145 so that the vacuum cups 135 are coupled to the vacuum pump 145, so that any vacuum pulled by the vacuum pump 145 is also pulled in the vacuum cups 145. The vacuum pump 145 can be powered by many methods including, but not limited to battery, external electricity combustion engine and solar power. A power switch 155 is connected to the frame 105 and is electrically coupled to the vacuum pump 145.

Also attached to frame 105 is a vacuum valve (not shown) mounted inside of housing 152 and operated by handle 153. The purpose of valve 11 is to communicate, through hose 154, to the vacuum pump 145 and to release the vacuum on the pump at desired times to thereby remove the vacuum from the cups 135.

FIG. 2 illustrates an embodiment of a vacuum cup frame 125 and a block of material 190. The frame 125 includes a first bar 126 connected to a and substantially perpendicular to a second bar 127. One end of the first bar 126 can be pivotally connected to a bar 130 at point 131 of the frame 105 as described above with respect to FIG. 1. Two inclined bars 128 are connected to both the first and second bars 126, 127. Additional plates 132 can be connected to the first bar 126 at the pivot point 131. Cylindrical tubes 129 are connected periodically and substantially parallel to the bar 127. A cylindrical bar 136 is located within the tubes 129 and within cylindrical tubes 141 that are connected to the attachment plates 140. The cylindrical tubes 129, 141 are generally aligned and interleaved. As described above, the attachment plates 140 are connected to the vacuum cups 135. The bar 136 can be removed from the tubes 129, 141 so to separate the attachment plates 140 and the vacuum cups 135 from the frame 125. When in place, the bar 136 is a pivot point so that the vacuum cups 135 can pivot with respect the frame 125. The figure further illustrates that the vacuum cups 135 are affixed to a piece of material 190, the material typically being a block of saw cut concrete.

Figure 3:
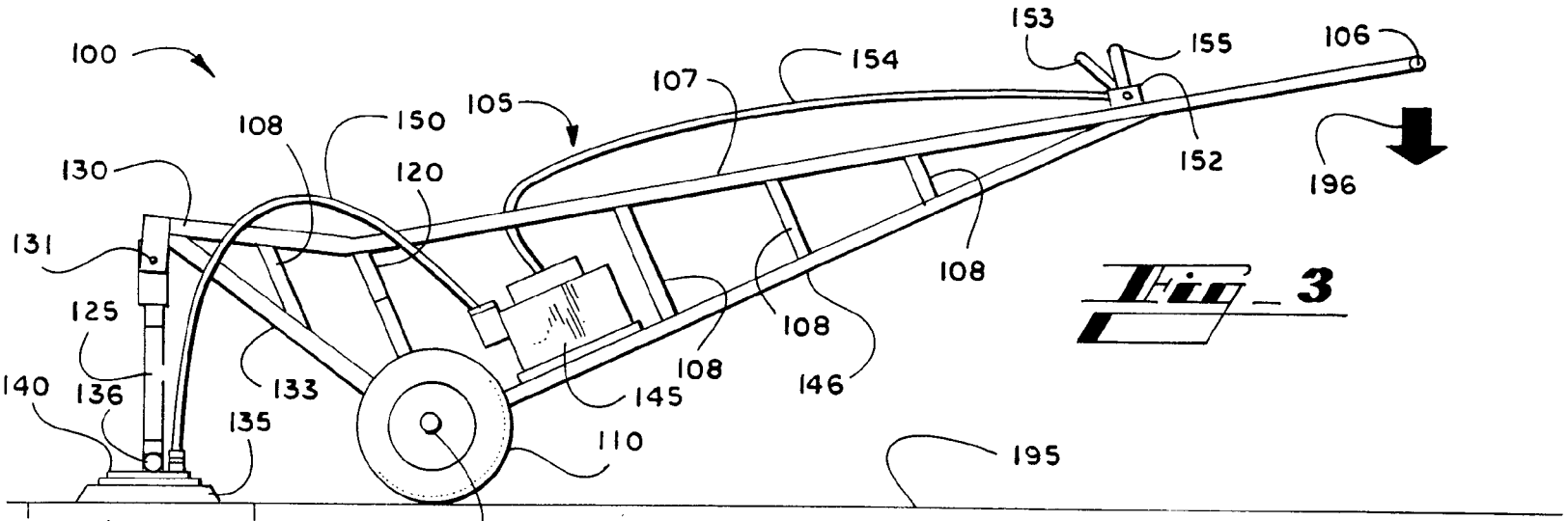
FIG. 3 illustrates a side view of an embodiment of a concrete extraction apparatus in a lowered position.

FIG. 3 illustrates a side view of an embodiment of a concrete extraction apparatus 100 in a lowered position. This side view illustrates that the first upper bar 107 and first lower bar 146 substantially form a first triangle having a portion of the frame 120 as its base. The second upper bar 130 and second lower bar 133 substantially form a second triangle having a portion of the frame 120 as its base. The first and second triangles are on opposite sides of the wheel pivot bar 115. The wheel pivot bar 115 acts as a fulcrum for the apparatus 100 as is described further below. FIG. 3 illustrates the apparatus 100 in a lowered position wherein the vacuum cups 135 are in contact with the material 190 to be lifted from a surface 195.

Figure 4:
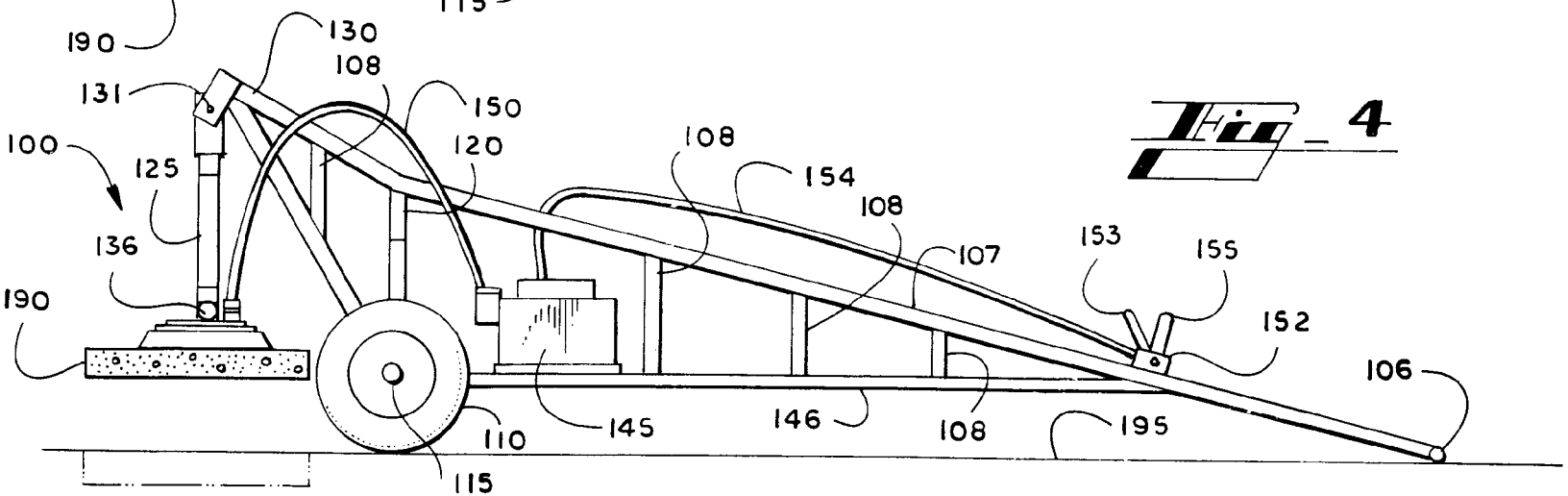
FIG. 4 illustrates a side view of an embodiment of a concrete extraction apparatus in a raised position.

FIG. 4 illustrates a side view of an embodiment of a concrete extraction apparatus 100 in a raised position. In this position, the vacuum cups 135 are affixed to the material 190 that has been removed from the surface 195.

Concrete Extraction Method

Referring again to FIGS. 3–4, a method for extracting material is now described. Once a piece of material, typically a cut concrete block, is identified for removal, the operator of the apparatus 100 can wheel the apparatus by engaging the handling bar 106 and maneuvering the apparatus 100 using the wheels 110. The operator typically then positions the apparatus 100 so that the vacuum cups 135 are positioned above the piece of material, such as material 190, to be moved. The figures above so that the apparatus typically includes two vacuum cups 135. However, more or less vacuum cups 135 can be placed on the frame 125 as needed. For example, a smaller piece of material may only require one vacuum cup 135.

Once the vacuum cups 135 are positioned over the material the operator can lower the vacuum cups 135 so that they are in contact with the material 190. The lowering of the vacuum cups 135 is possible by the lever and fulcrum characteristic of the apparatus 100. The operator can apply an upward or downward force on the handling bar 106 so that the triangle defined by bars 107, 146 can be used as a lever. The pivot point, or fulcrum is thus centered on the wheels 110, or more specifically, the wheel pivot bar 115. Once the vacuum cups 135 are positioned, the operator can then engage the power switch 155 that powers on the vacuum pump 145. The hoses 150 are connected between the vacuum pump 145 and the vacuum cups 135 so that a vacuum can be formed in the volume of space defined within the vacuum cups 135 and the portion of the surface of the material 195 that the vacuum cups 135 cover. As described above, the vacuum cups 135 include a resilient, flexible and durable material that is able to fit onto a surface that probably includes some irregularities. Therefore, as a vacuum is formed, the vacuum cups can conform to make a suitable seal for a vacuum. In an implementation, if the vacuum cups 135 don't initially form a vacuum, there may be a space around the vacuum cups 135. The operator can apply an upward force on the handling bar 106 so that the vacuum cups push harder on the surface of the material 190 and conform to whatever surface irregularities may be causing a break in the seal.

Once a suitable seal and vacuum are formed, the operator can apply a downward force on the handling bar 106, such as in the direction of arrow 196. With a vacuum formed, the material 190 remains in contact with the vacuum cups 135 and therefore lifts as the operator applies the downward force. The triangle defined by the bars 130, 133 is typically angled upward with respect to the frame. This upward angle allows clearance for the frame 125, vacuum cups 135 and material 190. The upward angle also provides an initial upward displacement in the direction of the lift.

Furthermore, the distance generally between the wheel pivot bar 115 and the end of the bar 130, is shorter than the distance generally defined between the wheel pivot bar to the handling bar 106. It is an accepted physical concept that the torque in a system such as the apparatus 100 is defined by the force on the lever multiplied by the distance between the pivot point and the point at which the force is applied, assuming that the force is perpendicular to the distance. Therefore a greater torque can either be achieved by a greater applied force or by increasing the distance to the pivot point. Since the material block applies a large gravitational force downward, it is useful to shorten the distance between the point of force and the pivot point. In addition, since the operator is trying to decrease the amount of force the operator has to apply, it is useful to lengthen the distance between the point of the operator's applied force and the pivot point. Therefore, it is useful that the distance generally defined between the wheel pivot bar 115 and the end of the bar 130, is shorter than the distance generally defined between the wheel pivot bar to the handling bar 106. This distance differential typically results in a wider range of motion for the operator and a shorter range of motion from the material 190.

Once the operator has lifted the piece of material 190, the user can move the apparatus 100 using wheels 110 while keeping the material 190 elevated. In general, pivot point 131 and a pivot point at bar 136 allow the material 190 to gently swing as the apparatus 100 is lifted and moved. These pivot points remove rigidity from the apparatus 100. Once the operator has found a suitable location to lay the material 190, the operator can apply a force upward on the handling bar 106 to lower the material 190. Typically, the material 190 is heavy enough so that simply decreasing the downward force on the handling bar 106 allows the material 190 to lower. The operator can then move handle 153 to open the vacuum valve in housing 152 to release the vacuum from the vacuum in the vacuum cups 135. Once the vacuum is released, the vacuum cups typically release the material 190. The operator can then move the apparatus 100 as desired.

Alternate Embodiment of a Concrete Extraction Apparatus

Figure 5:
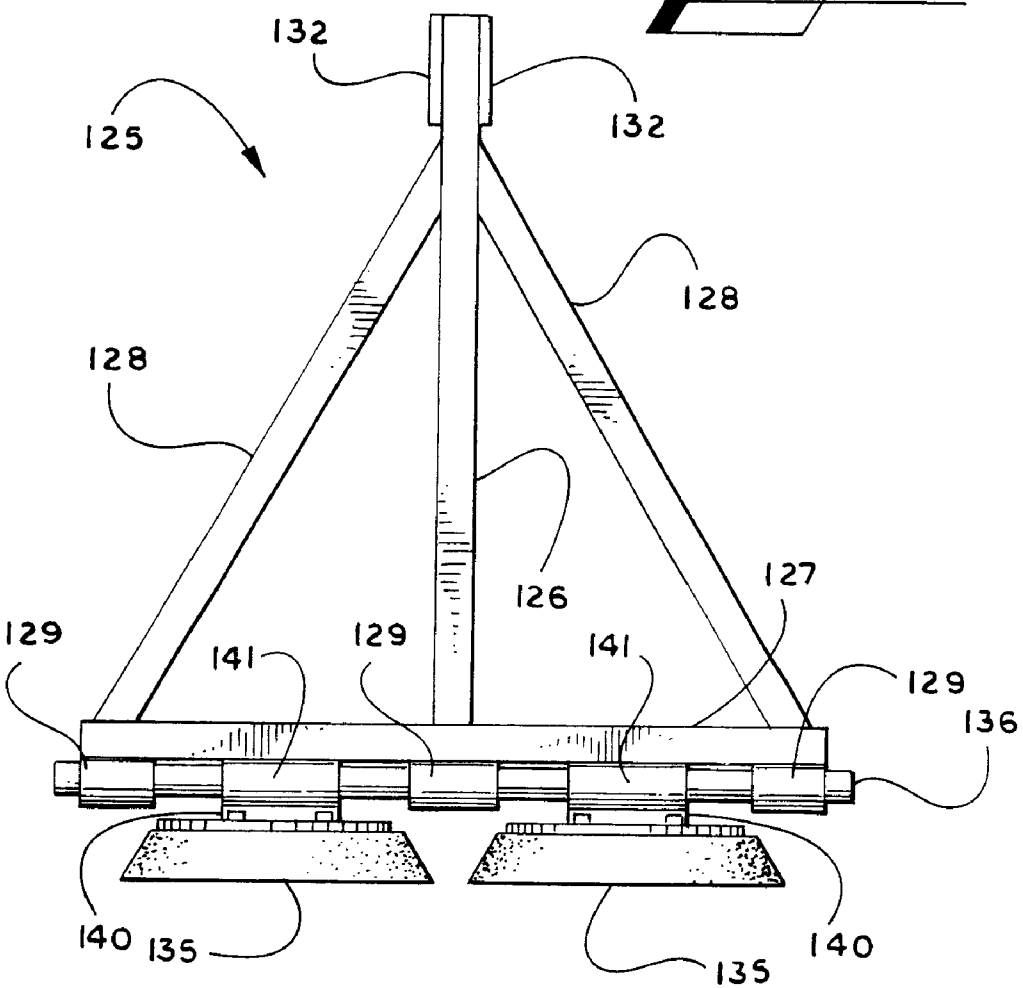
FIG. 5 illustrates a front view of an embodiment of an A-frame vacuum cup attachment.

FIG. 5 illustrates a front view of an embodiment of an vacuum cup frame 125. As discussed above, the frame 125 typically includes two vacuum cups 135. Alternatively fewer or more vacuum cups 135 can be added. In the case of adding additional vacuum cups, the bar 127 and the bar 136 can be lengthened to accommodate additional vacuum cups 135. By removing the bar 136 from the cylindrical tubes 129, 141, the vacuum cups 135 can be removed from the frame 125. By detaching the hoses 150 (See FIG. 1 and FIGS. 3–4 above) from the vacuum cups 135 the vacuum cups 135 can be removed from the apparatus 100.

Figure 6:
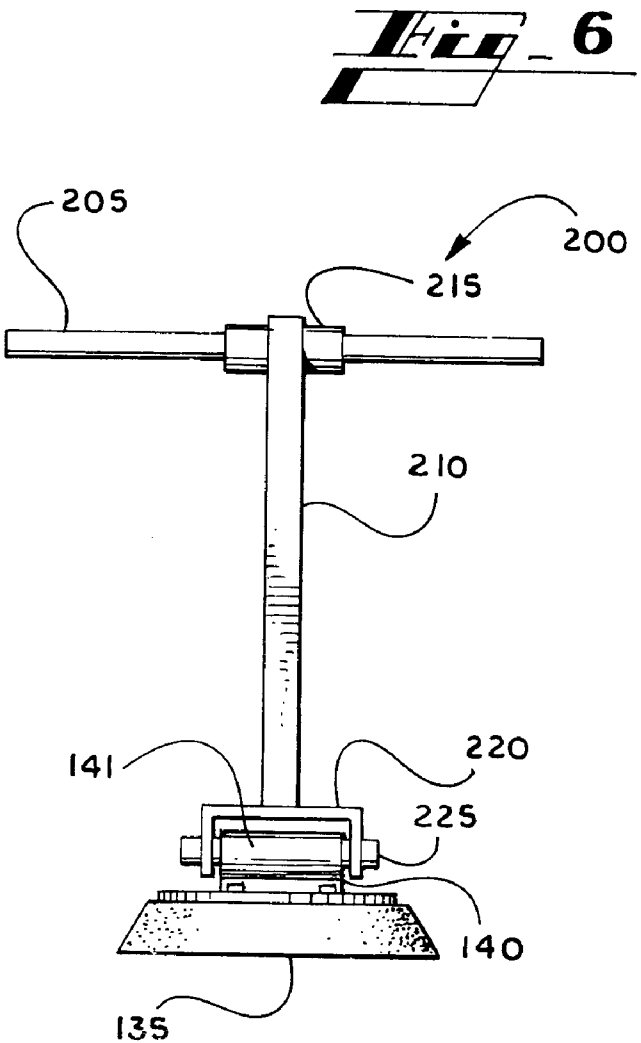
FIG. 6 illustrates a view of an alternate embodiment of a concrete extraction apparatus.

FIG. 6 illustrates a view of an alternate embodiment of a concrete extraction apparatus 200. The vacuum cups 135 removed from the apparatus 100 above or aa different vacuum cup 135 can be used in the alternate embodiment. The apparatus 200 includes a handling bar 205 connected to a bar 210. As described further below with respect to FIG. 7, the handling bar is connected to the bar 210 by a cylindrical tube 215. A bracket 220 is connected to the bar 210 at the end of the bar 210 opposite the handling bar 205. A bar 225 is pivotally connected to the bracket 220. The bar 225 also is pivotally connected to the cylindrical tube 141 that is connected to the attachment plate 140. As described above, the attachment plate 140 is connected to the vacuum cup 135.

Figure 7:
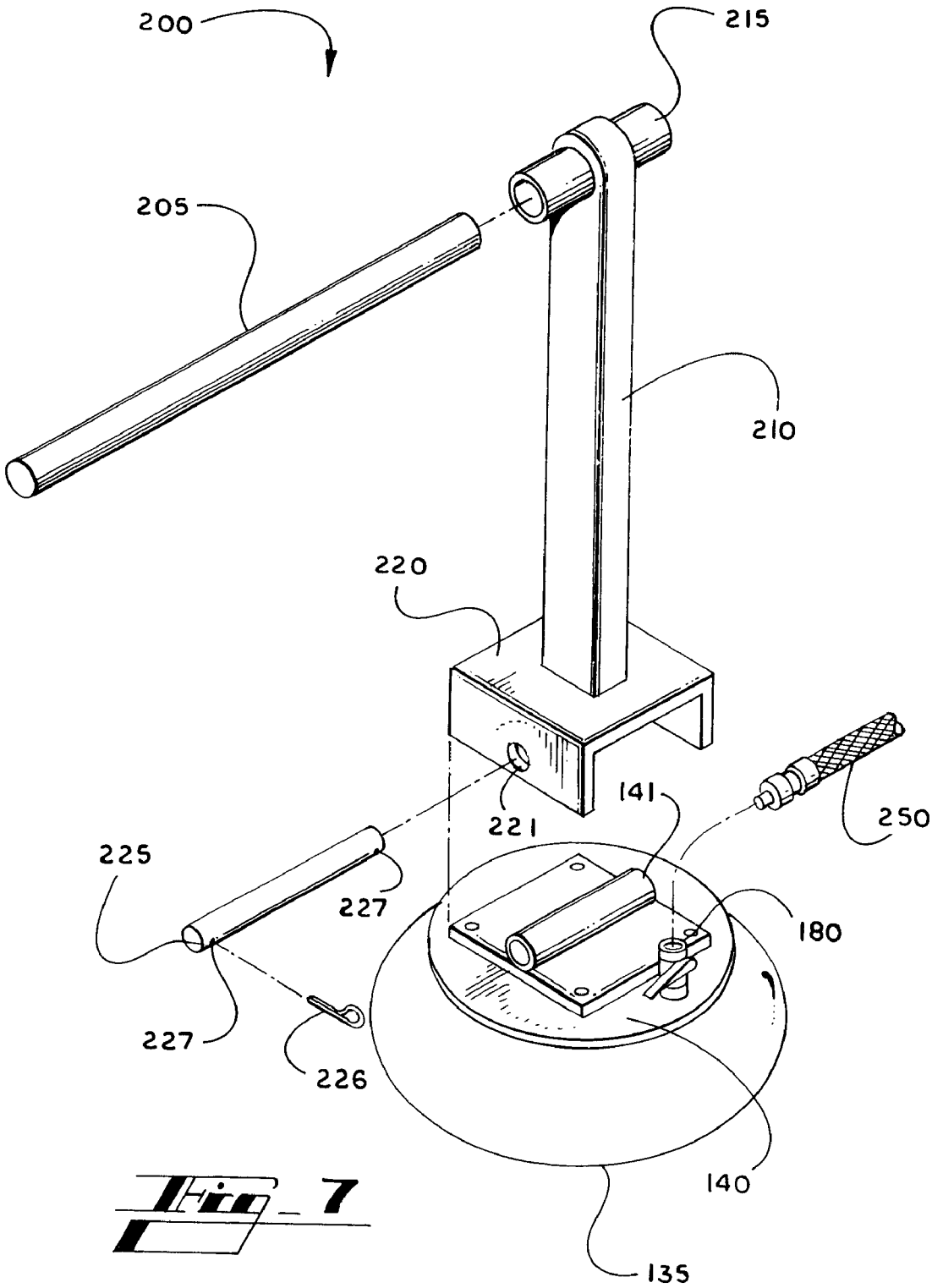
FIG. 7 illustrates the component pieces of the alternate embodiment of a concrete extraction apparatus of FIG. 6.

FIG. 7 illustrates the component pieces of the alternate embodiment of a concrete extraction apparatus 200 of FIG. 6. As described above, the handling bar 205 connects to the bar 210 through the cylindrical tube 215 at one end of the bar 210. At the other end of the bar, the cylindrical tube 141 can be connected to the bracket 220 by placing the bar 225 through the holes 221 on the bracket 220 and through the cylindrical tube 141. Once the bar 225 is in proper position set pins 226 can be placed into holes 227 on either end of the bar 225 to keep the bar 225 in position. The figure also illustrates a vacuum coupler 180 on the vacuum cup 135 onto which a vacuum hose 250 can be connected from a vacuum pump so that a vacuum can be pulled on the vacuum cup 135. In an implementation, the coupler 180 and the hose 250 have quick release connections so that the hose 250 can be easily connected and disconnected.

Alternate Concrete Extraction Method

Referring again to FIGS. 6 and 7, an alternate method of concrete (or other material) extraction is described. Using this apparatus, one or more operators can use the apparatus to remove material that may not be accessible by larger equipment such as apparatus 100 described above, or it may be used for smaller pieces.

The operator can place the apparatus 200 on a piece of concrete to be removed. Once the vacuum cup 135 is positioned, the operator can power on the vacuum so that a vacuum can be formed in the volume of space defined within the vacuum cup 135 and the portion of the surface of the material that the vacuum cup 135 covers. As described above, the vacuum cup 135 includes a resilient, flexible and durable material that is able to fit onto a surface that probably includes some irregularities. Therefore, as a vacuum is formed, the vacuum cup 135 can conform to make a suitable seal for a vacuum. In an implementation, if the vacuum cup 135 does not initially form a vacuum, there may be a space around the vacuum cup 135. The operator can apply an downward force on the handling bar 205 so that the vacuum cup 135 pushes harder on the surface of the material and conforms to whatever surface irregularities may be causing a break in the seal.

Once a suitable seal is formed, the operator can apply an upward force on the handling bar 205, typically lifting the entire apparatus 200. The operator (or operators, if necessary) can then find a desired location for the material and put the apparatus 200 and the material down on the location. The vacuum can then be removed, thereby releasing the vacuum cup 135 from the material. The operator can then move the apparatus 200 to a desired location.

Although the systems and methods described above have used removal of concrete blocks as the typical implementation for the systems and methods, it is understood that the systems and methods can be used in other implementations. For example, the concrete extraction apparatus can be used to move any material that is cumbersome and difficult to move such as marble for laying marble floors. There is not a limit to the materials that can be moved by the apparatus.

The two embodiments described above can be characterized as leveraging devices for the vacuum cups in general. The leveraging devices, vacuum cups and vacuum pumps can be packaged for use in a concrete extraction kit.

Therefore, the foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. An extraction apparatus, comprising:

an elongated frame having a first end and a second end;

a handling bar connected to the first end of the frame;

a vacuum cup frame connected to the second end of the frame;

a vacuum cup connected to the vacuum cup frame;

a wheel pivot bar connected to the frame between the first and second ends;

wheels connected to the wheel pivot bar; and wherein the elongated frame comprises:

a first upper bar connected to a second upper bar at an angle, the first upper bar being connected to the handling bar;

a first lower bar connected to the first upper bar at an angle, and connected to a second lower bar, the second lower bar being connected to the second upper bar at an angle; and a support frame connected to the wheel pivot bar and to the intersection of the first upper bar and second upper bar.

2. The apparatus as claimed in claim 1, wherein the distance between the wheel pivot bar and the second end is less than the distance between wheel pivot bar and the first end.

3. The apparatus as claimed in claim 2, wherein the wheels are adapted to be a fulcrum.

4. The apparatus as claimed in claim 1 further comprising a vacuum pump connected to the frame and a hose connected between the vacuum pump and the vacuum cup.

5. An extraction apparatus, comprising:

an elongated frame having a first end and a second end;

a handling bar connected to the first end of the frame;

a vacuum cup frame connected to the second end of the frame;

a vacuum cup connected to the vacuum cup frame;

a wheel pivot bar connected to the frame between the first and second ends;

wheels connected to the wheel pivot bar; and wherein the vacuum cup frame comprises:

a first bar;

a second bar connected to and substantially perpendicular to the first bar; and a series of cylindrical tubes connected to and substantially perpendicular to the second bar.

6. The apparatus as claimed in claim 5, wherein the vacuum cup frame further comprises inclined bars connected to the first bar and the second bar.

7. The apparatus as claimed in claim 5, wherein the vacuum cup comprises a series of cylindrical tubes that interleave and align with the cylindrical tubes on the vacuum cup frame.

8. An extraction apparatus, comprising:

a bar having a first end and a second end;

a handling bar connected substantially perpendicular to the bar at the first end;

a bracket connected to the second end of the bar;

a vacuum cup connected to the bracket; and a bar connected to the bracket and to a cylindrical tube on the vacuum cup.

9. The apparatus as claimed in claim 8, further comprising a vacuum pump and a hose connected to the vacuum pump and to the vacuum cup.

* * * * *